US011371289B2

(12) United States Patent
Gurjar et al.

(10) Patent No.: US 11,371,289 B2
(45) Date of Patent: Jun. 28, 2022

(54) DRIVE SHAFT ASSEMBLY FOR DOWNHOLE DRILLING AND METHOD FOR USING SAME

(71) Applicant: Wenzel Downhole Tools ULC, Edmonton (CA)

(72) Inventors: Rishi Gurjar, Edmonton (CA); David Bartels, Edmonton (CA)

(73) Assignee: Wenzel Downhole Tools ULC, Edmonton (CA)

( * ) Notice: Subject to any disclaimer, the term of this patent is extended or adjusted under 35 U.S.C. 154(b) by 0 days.

(21) Appl. No.: 16/985,380

(22) Filed: Aug. 5, 2020

(65) Prior Publication Data

US 2021/0040797 A1 Feb. 11, 2021

Related U.S. Application Data

(60) Provisional application No. 62/883,281, filed on Aug. 6, 2019.

(51) Int. Cl.
*E21B 7/06* (2006.01)
*E21B 4/02* (2006.01)

(52) U.S. Cl.
CPC ..... *E21B 7/067* (2013.01); *E21B 4/02* (2013.01)

(58) Field of Classification Search
CPC ... E21B 7/04; E21B 7/06; E21B 7/067; E21B 4/02
See application file for complete search history.

(56) References Cited

U.S. PATENT DOCUMENTS

2009/0275415 A1* 11/2009 Prill ..... E21B 4/02 464/152
2016/0333941 A1* 11/2016 Touchette, Jr. ..... F16D 3/221

* cited by examiner

*Primary Examiner* — Dany E Akakpo
(74) *Attorney, Agent, or Firm* — Ted M. Anthony

(57) ABSTRACT

A drive shaft assembly for use with downhole mud motors is capable of handling greater torque and thrust forces. The drive shaft assembly has an elongated central drive shaft, and at least one end housing optionally disposed at one or both ends of the central drive shaft. At least one end of the central drive shaft defines a rounded or partially-spherical outer end surface and a plurality of elongate protrusions or "keys" that extend radially outward from the exterior surface of the shaft. Each end housing has a concave interior surface defining a seat for receiving a rounded end surface of the central drive shaft, as well as a plurality of circumferentially spaced axial keyways adapted to receive and engage with the keys in mating relationship. The shaft and end assemblies cooperate to facilitate omnidirectional pivotal movement and the transfer of torque forces between the shaft and each of said end housings.

15 Claims, 12 Drawing Sheets

DRIVE SHAFT ASSEMBLY FOR DOWNHOLE DRILLING AND METHOD FOR USING SAME

BACKGROUND OF THE PRESENT INVENTION

1. Field of the Invention

The present invention pertains to downhole drilling equipment for wells penetrating subterranean formations including, without limitation, oil and gas wells. More particularly, the present disclosure pertains to a drive shaft assembly for use with a downhole motor. More particularly still, the present invention pertains to a drive shaft assembly that efficiently and effectively transfers torque forces, rotation and thrust loads between downhole drilling equipment situated within a wellbore.

2. Description of Related Art

In many cases, wells drilled into subterranean formations can be deviated from a purely vertical path or orientation. Such wells can have at least one curved or bent section, sometimes referred to as a "dog leg." Frequently, conventional drilling methods are unable to create such curved portion(s) of the borehole and steer a wellbore in desired direction(s). Thus, downhole mud motors are frequently used to drill curved portions of a wellbore, and such mud motors typically include a bent or curved segment as part of the bottom hole assembly.

In most cases, downhole mud motors typically consist of three major components: a power section (typically consisting of a rotor and a stator); a bearing assembly; and a drive shaft assembly that connects said power section to said bearing assembly. Generally, the power section converts fluid pressure from pumped drilling fluid into mechanical (typically rotational) energy; said drilling fluid acts on said rotor, causing the rotor to rotate or spin within the surrounding stator. The drive shaft is typically operationally connected to said rotor, and must transfer torque forces and rotation from the rotor to said bearing assembly, while also accommodating downhole thrust loads encountered during the drilling process. Such thrust loads include axial forces that are generally aligned with the longitudinal axis of section of a wellbore.

Said drive shaft is frequently encased within a surrounding housing. In many cases, said housing can be bent or curved in order to facilitate drilling of a curved or deviated wellbore section. As a result, the drive shaft (contained within said housing) must also accommodate said bend in the housing. In such cases, the drive shaft must be sufficiently strong to withstand—and transfer—torque forces generated by the power section, while accommodating the (frequently eccentric) rotation of the rotor and the bend in said drive shaft housing.

It is often beneficial to utilize longer power sections in order to generate greater torque forces; as the rotors and stators in power sections are lengthened, such power sections produce greater torque forces. The torque force output of power sections has increased to the point that drive line failures are being experienced with the use of conventional drive shafts.

Thus, there is a need for an improved drive shaft capable of withstanding the torque forces generated by power sections of modern downhole drilling devices, without being susceptible to the negative effects of these torque demands, or from high temperatures, high pressures, and other factors associated with a mud motor in a downhole drilling environment.

SUMMARY OF THE INVENTION

The present invention comprises a drive shaft assembly—sometimes referred to as a drive line—for use with downhole mud motors and well drilling operations. The drive shaft assembly of the present invention is capable of handling greater torque and thrust forces than conventional drive shaft assemblies.

In a preferred embodiment, the drive shaft assembly of the present invention comprises an elongated central drive shaft and at least one end housing; said end housing(s) can optionally be disposed at one or both ends of said central drive shaft. In a preferred embodiment, said central drive shaft has a substantially cylindrical shape with opposed first and second ends. Each end of said central drive shaft that is equipped with an end housing defines a rounded or partially-spherical outer end surface. Further, each end housing has a substantially concave interior surface defining a seat for receiving a rounded end surface of said central drive shaft. Said shaft and seat assemblies facilitate omnidirectional pivotal movement between said shaft and each of said end housings.

A plurality of elongate protrusions or "keys" extend radially outward from the exterior surface of the shaft at each of said rounded or partially-spherical end surface. Additionally, a plurality of circumferentially spaced axial keyways is provided in the interior surface of each of the end housings; said keyways are adapted to receive and engage with said keys of said shaft in mating relationship. Each of said keys has opposed sides, opposed ends, a rear face and a front face. The front face is radiused to facilitate omnidirectional, pivotal movement of said shaft relative to the adjoining housing(s). Said elongate keys (including, without limitation, the dimensions and geometry thereof) greatly increases the surface contact area and cross sectional shear area thereof, thereby increasing the torque load capacity of the drive line.

The driveline assembly of the present invention can be beneficially housed within an outer housing assembly. Said outer housing assembly can comprise a bend with each opposing end set at a different axis angle relative to the opposing end. Said housing assembly can also be optionally configured such that each opposing end is aligned (i.e., straight). The drive shaft assembly of the present invention allows for articulation in virtually any radial direction relative to its central longitudinal axis, while also permitting transfer of rotational and thrust forces across said drive shaft assembly. Further, the drive shaft assembly of the present invention is capable of handling greater torque and thrust forces than conventional drive shaft assemblies.

BRIEF DESCRIPTION OF THE DRAWINGS

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

While the present invention will be described with reference to preferred embodiments, it will be understood by those skilled in the art that various changes may be made and equivalents may be substituted for elements thereof without departing from the scope of the present invention. In addition, many modifications may be made to adapt a particular situation or material to the teachings of the invention without departing from the essential scope thereof. Therefore, it is intended that the present invention not be limited to the particular embodiments disclosed as the best mode contemplated for carrying out this invention, but that the invention will include all embodiments (and legal equivalents thereof).

Figure 1:
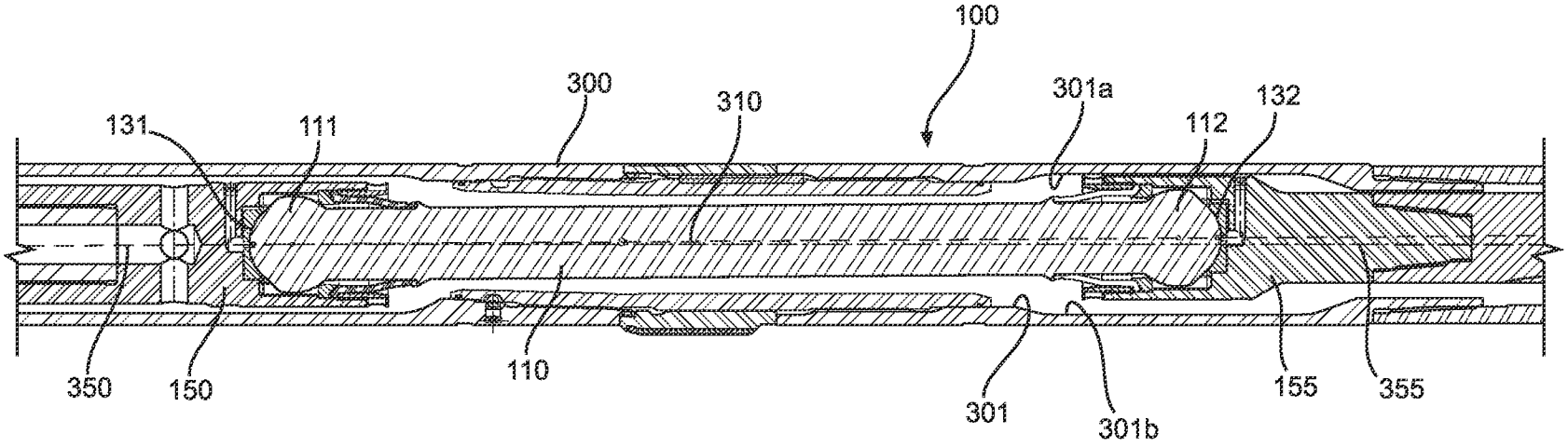
FIG. 1 depicts a side sectional view of a drive shaft assembly of the present invention.

FIG. 1 depicts a side sectional view of drive shaft assembly 100 of the present invention, sometimes also referred to herein as a "driveline assembly". Said drive shaft assembly 100 generally comprises a central drive shaft 110 having a first end 111 and a second end 112. In the embodiment depicted in FIG. 1, an end housing is disposed at each of said opposing ends 111 and 112 of said central drive shaft 110; end housing 150 is disposed at first end 111, while end housing 155 is disposed at second end 112. First end 111 defines a substantially hemispherical end section having a rounded or partially spherical and convex outer end surface 131. Similarly, second end 112 also defines a substantially hemispherical end section having a rounded or partially spherical and convex end surface 132.

Drive shaft assembly 100 of the present invention can be beneficially housed within a central inner bore 301 of an outer housing assembly 300. As depicted in FIG. 1, central longitudinal axis 310 of drive shaft 110, central longitudinal axis 350 of end housing 150 and central longitudinal axis 355 of end housing 155 are all substantially aligned. Said outer housing assembly 300 can be substantially straight—that is, having a single linear axis from end to end. Alternatively, said outer housing assembly 300 can have at least one bend or angle to accommodate downhole conditions and/or operational parameters.

Figure 1A:
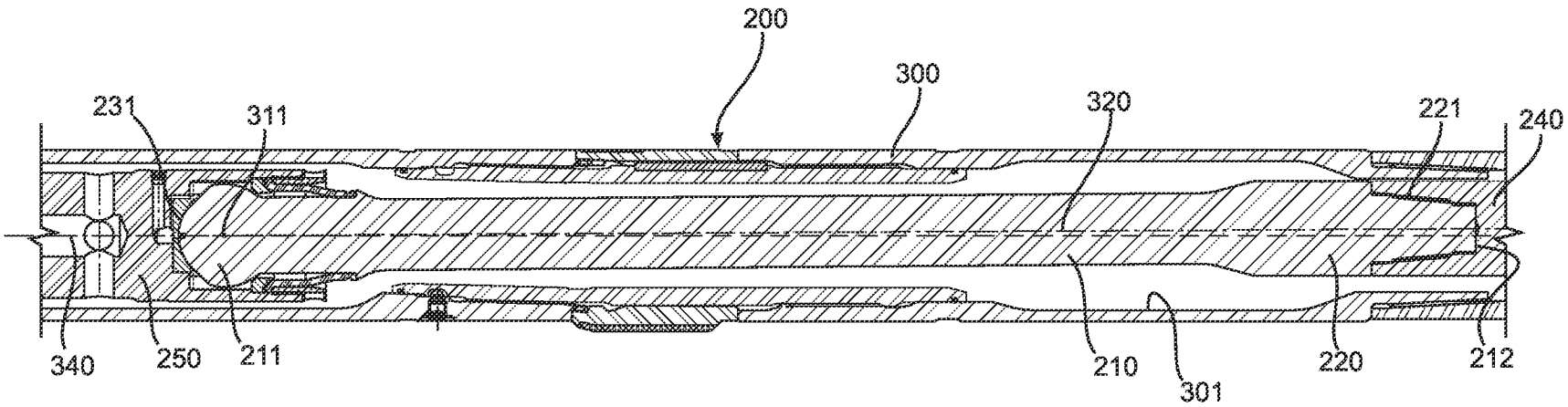
FIG. 1A depicts a side sectional view of a first alternative embodiment drive shaft assembly of the present invention.

FIG. 1A depicts a side sectional view of a first alternative embodiment drive shaft assembly 200 of the present invention. Said first alternative drive shaft assembly 200 generally comprises a central drive shaft 210 having a first end 211 and a second end 212. End housing 250 is disposed at end 211 of said central drive shaft 210. End 211 defines a substantially spherical end section having a rounded or partially spherical outer end surface 231.

A connection member 220 is disposed near opposing second end 212 of said central drive shaft 210. In a preferred embodiment, said connection member 220 comprises a threaded pin-end connection member having external pipe threads 221 that can be selectively engaged with mating threads of tubular drill string or other downhole component 240. However, it is to be observed that a different type of connection or coupling member can be utilized for this purpose without departing from the scope of the present invention.

Drive shaft 210 of alternative embodiment drive shaft assembly 200 can be beneficially enclosed within central inner bore 301 of outer housing assembly 300. Said outer housing assembly 300 can be configured such that each opposing end is aligned—that is, in substantially straight or linear orientation. Alternatively, said outer housing assembly 300 of alternative embodiment drive shaft assembly 200 can have at least one bend or angle to accommodate downhole conditions and/or operational parameters. As depicted in FIG. 1A, central longitudinal axis 320 of drive shaft 210 and central longitudinal axis 340 of end housing 250 are substantially aligned.

Figure 2:
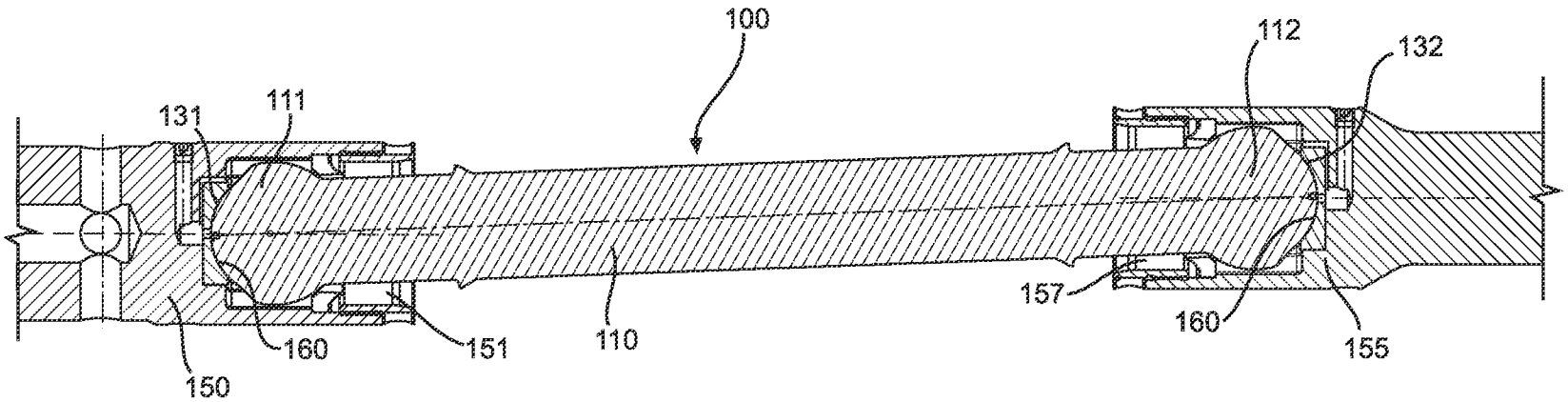
FIG. 2 depicts a side sectional view of a drive shaft assembly of the present invention in an articulated configuration.

FIG. 2 depicts a side sectional view of drive shaft assembly 100 of the present invention in an articulated configuration. As noted above, said drive shaft assembly 100 generally comprises a central drive shaft 110 having a first end 111 and a second end 112. End housings 150 and 155 are disposed at each of said opposing ends 111 and 112, respectively. Outer housing assembly 300 is not depicted in FIG. 2 for clarity; however, it is to be observed that said drive shaft assembly 100 can include said outer housing 300 for containing central drive shaft 110 and end housings 150 and 155.

Still referring to FIG. 2, first end 111 of comprises a rounded or partially spherical section defining outer end surface 131, while opposing second end 112 comprises a rounded or partially spherical section defining end surface 132. End housing 150 further comprises a central bore 151 defining an inner space and a substantially concave interior surface 160 defining a seat disposed within said central bore 151 for receiving rounded end surface 131 of said central drive shaft 110. Similarly, end housing 155 likewise comprises a central bore 157 defining an inner space and a substantially concave interior surface 160 defining a seat disposed within said central bore 157 for receiving rounded end surface 132 of said central drive shaft 110.

Each of said end housings 150 and 155 is disposed at an end portion of drive shaft 110; end housing 150 is disposed at end 111, while end housing 155 is disposed at end 112 of said drive shaft 110. End 111 of drive shaft 110 is moveably disposed relative to said end housing 150, while end 112 of drive shaft 110 is moveably disposed relative to said end housing 155. As such, drive shaft 110 can articulate, thereby allowing the longitudinal axis of said drive shaft 110 (axis 310 depicted in FIG. 1) to move out of linear alignment with the longitudinal axis of end housing 150 (axis 350 depicted in FIG. 1) and end housing 155 (axis 355 depicted in FIG. 1).

Figure 2A:
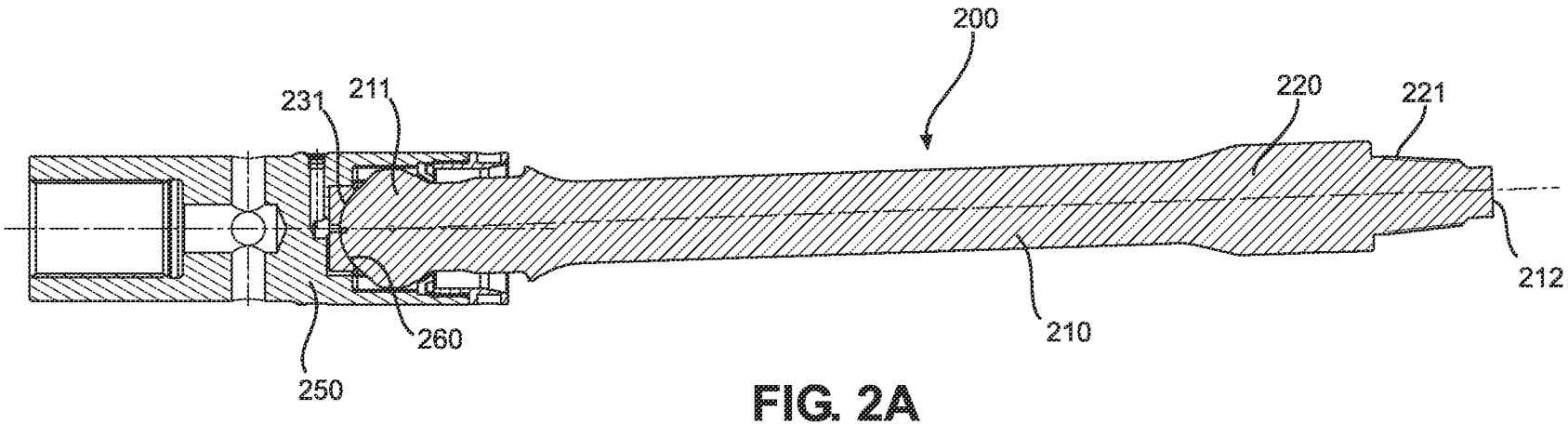
FIG. 2A depicts a side sectional view of a first alternative embodiment drive shaft assembly of the present invention in an articulated configuration.

FIG. 2A depicts a side sectional view of a first alternative embodiment drive shaft assembly 200 of the present invention in an articulated configuration; outer housing 300 is not shown in FIG. 2A for clarity. Said first alternative embodiment drive shaft assembly 200 generally comprises a central drive shaft 210 having a first end 211 and a second end 212. End housing 250 is disposed at said first end 211 of said central drive shaft 210, while connection member 220 is disposed near opposing second end 212 of said central drive shaft 210. End 211 defines a substantially spherical end section having a rounded or partially spherical outer end surface 231. As depicted in FIG. 2A, said connection member 220 comprises a threaded pin-end connection member having external pipe threads 221 that can be selectively engaged with mating threads of tubular drill string or other downhole component (not depicted in FIG. 2A).

Still referring to FIG. 2A, end housing 250 is disposed at end portion 211 of drive shaft 210. Drive shaft 210 is moveably disposed relative to said end housing 250. As such, drive shaft 210 can articulate relative to end housing 250, thereby allowing the central longitudinal axis of said drive shaft 210 (axis 320 in FIG. 1A) to move out of linear alignment with the longitudinal axis of said end housing 250 (axis 340 depicted in FIG. 1A).

Figure 3:
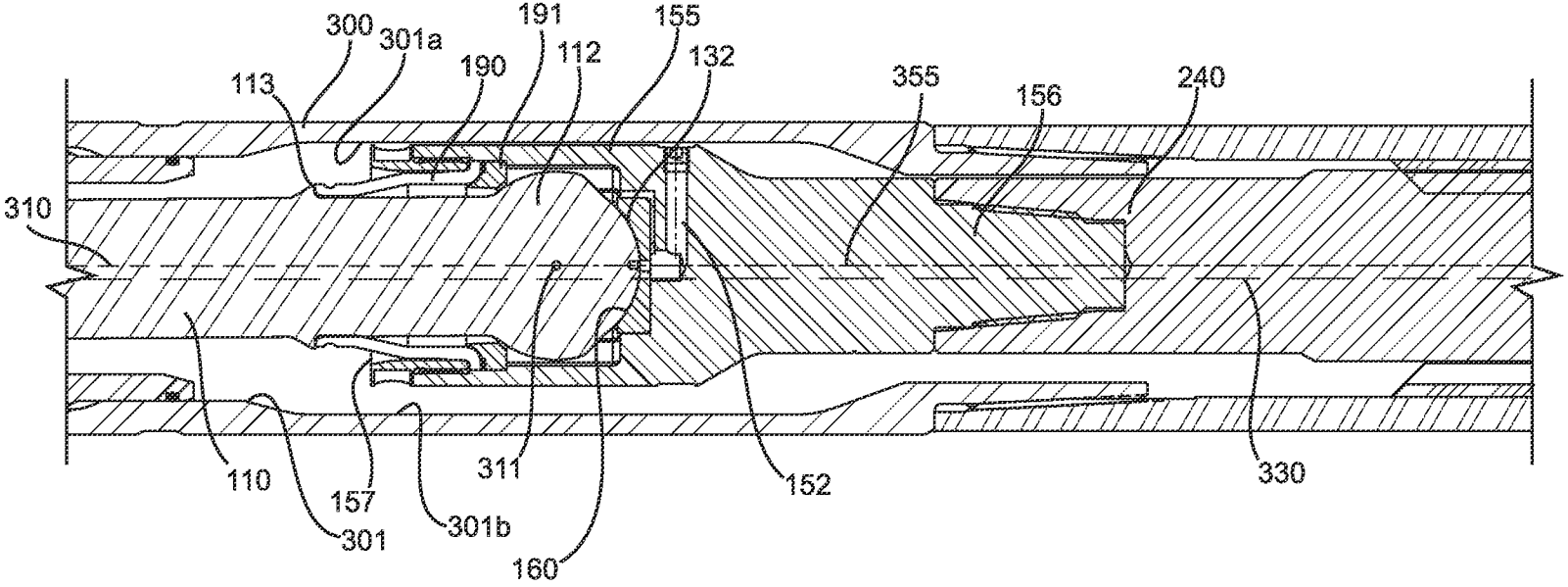
FIG. 3 depicts a side sectional view of a portion of a drive shaft and end housing of the present invention in a substantially linear configuration.

FIG. 3 depicts a side sectional view of a portion of a drive shaft 110 and end housing 155 of the present invention. Central drive shaft 110 has second end 112. moveably disposed within said end housing 155. Said central drive shaft 110 and end housing 155 are disposed within inner bore 301 of outer housing assembly 300. In the embodiment depicted in FIG. 3, end housing 155 further comprises connection member 156 that can be selectively engaged with mating threads of tubular drill string or other downhole component 240.

Still referring to FIG. 3, said second end 112 of central drive shaft 110 generally comprises a generally or substantially spherical section defining a rounded or partially spherical convex end surface 132. End housing 155 has a central bore 157 defining an inner space. A substantially concave interior surface 160 defining a seat for receiving rounded end surface 135 of said central drive shaft 110 is disposed within said inner space. Although not depicted in FIG. 3, it is to be understood that drive shaft 110 can articulate relative to end housing 155, thereby allowing longitudinal axis 310 of said drive shaft 110 to move out of linear alignment with longitudinal axis 355 of said end housing 155. Further, in the embodiment depicted in FIG. 3, end housing 155 is radially offset from the central longitudinal axis 330 of housing assembly 300; as depicted in FIG. 3, the distance between end housing 155 and inner surface 301*a* of central bore 301 is less than the distance between said end housing 155 and inner surface 301*b* of said central bore 301 of housing assembly 300.

In the embodiment depicted in FIG. 3, end 112 of drive shaft 110 can be enclosed within an articulation chamber that can beneficially contain oil, grease or other fluid. In this embodiment, flexible boot seal member 190 engages against upset shoulder 113 of drive shaft 110, and locking ring 191. Transverse bore 152 extends through end housing 155 and permits fluid communication into said articulation chamber. For clarity, not all of the above features associated with said articulation chamber are depicted in the appended drawings (including FIGS. 2, 2A and 4).

Figure 4:
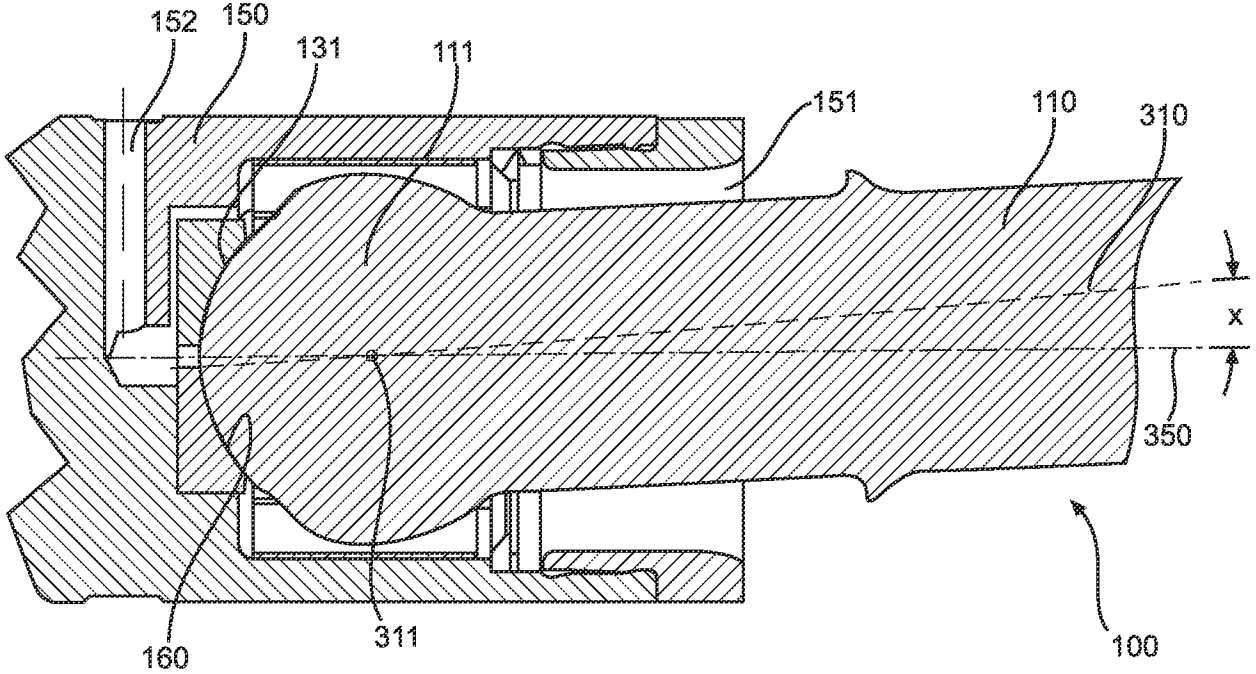
FIG. 4 depicts a side sectional detailed view of a portion of a drive shaft and end housing of a drive shaft assembly of the present invention in an articulated configuration.

FIG. 4 depicts a side sectional detailed view of an end portion of a drive shaft assembly 100 of the present invention in an articulated (i.e., not axially aligned) configuration. Central drive shaft 110 has a central longitudinal axis 310 and a first end 111 comprising a substantially spherical section. End housing 150 further comprises a central bore 151 defining an inner space and a substantially concave interior surface 160 defining a seat disposed within said inner space for receiving rounded end surface 131 of said central drive shaft 110. Said first end 111 has a rounded or partially spherical outer end surface 131 moveably disposed against concave interior seat surface 160 of end housing 150.

Transverse bore 152 can extend through end housing 150 to permit communication of fluid through said end housing member 150 (such as, oil, grease or other beneficial fluid). First end 111 of drive shaft 110 is received within said central bore 151 of end housing 150, while rounded end 131 of said central drive shaft 110 is engaged against said interior seat surface 160 of end housing 150. Said shaft and seat—and their respective configurations—cooperate to facilitate omnidirectional, pivotal movement between said shaft 110 and said end housing 150.

As depicted in FIG. 4, such articulation permits central longitudinal axis 310 of drive shaft 110 to move out of linear alignment with central longitudinal axis 350 of end housing 150, wherein the angle of such displacement is depicted as dimension "x" in FIG. 4. Notwithstanding such displacement, it is also to be understood that drive shaft 110 is capable of rotation about a stationary pivot or rotational axis that is oriented substantially perpendicular to the longitudinal axis 310 of drive shaft 110 and longitudinal axis 350 of end housing 150, and passes through center point 311.

Figure 5A:
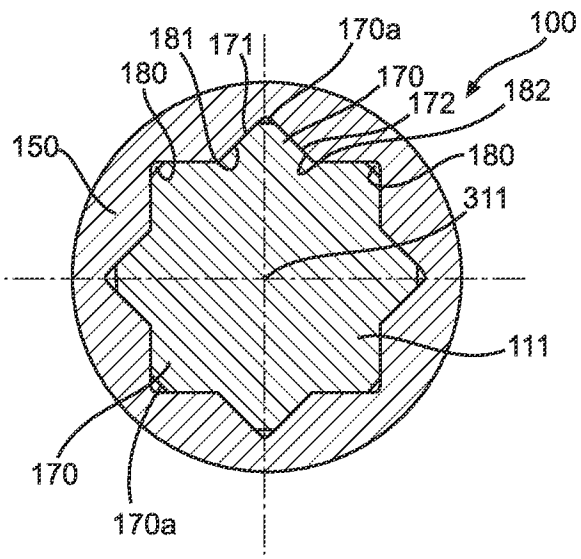
FIG. 5A depicts an end sectional view of an end portion of a drive shaft assembly of the present invention with no inserts installed.
Figure 5:
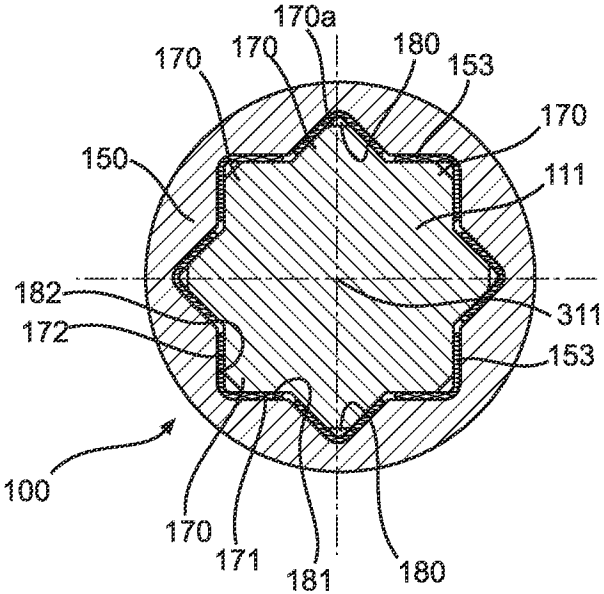
FIG. 5 depicts an end sectional view of an end portion of a drive shaft assembly of the present invention with inserts installed.

FIGS. 5 and 5A depict end sectional views of an end portion 111 of a central drive shaft 110 and end housing 150 of assembly 100 of the present invention; FIG. 5 depicts said assembly with inserts 153 installed, while FIG. 5 depicts said assembly without said inserts 153 installed. Referring to FIGS. 5 and 5A, a plurality of elongate protrusions or "keys" 170 extend radially outward from the exterior surface of said central drive shaft 110 at end 111 (and also end 112, although not depicted in FIGS. 5 and 5A). Additionally, a plurality of circumferentially spaced axial keyways 180 is provided in the interior surface of central bore 151 of end housing 150; said keyways 180 are adapted to receive said keys 170 at end 111 of central drive shaft 110 in mating relationship.

Figure 6:
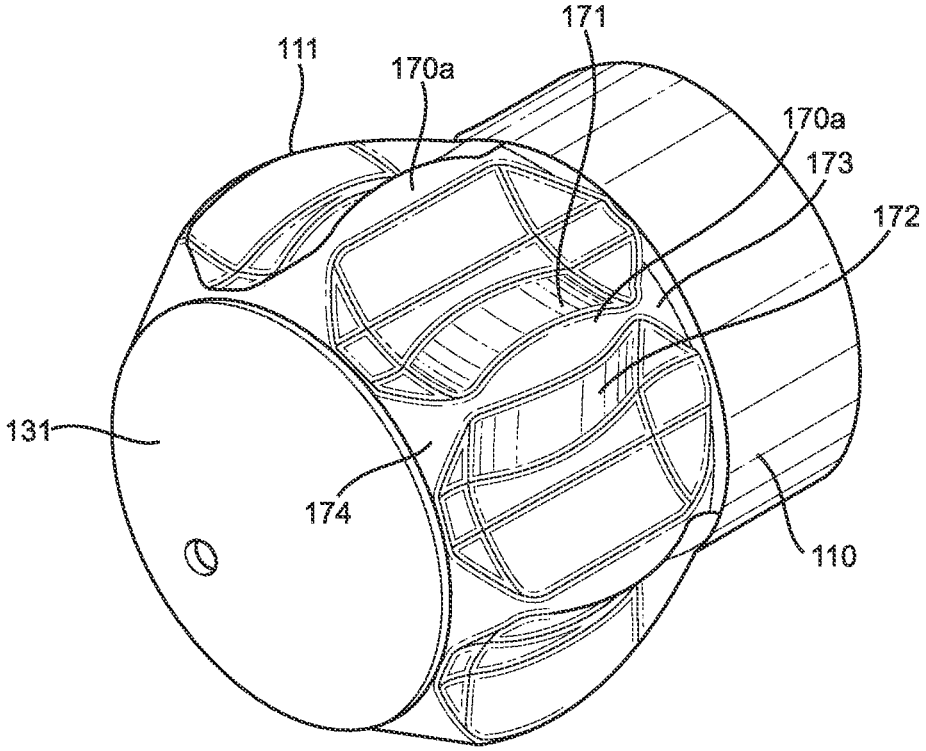
FIG. 6 depicts a side perspective view of an end of a drive shaft of the present invention.

FIG. 6 depicts a side perspective view of an end 111 of a drive shaft 110 of the present invention. As noted, a plurality of elongate protrusions or "keys" 170 extend radially outward from the exterior surface of said end 111 of central drive shaft 110. Each of said keys 170 has outer lateral surface 170*a*, opposed sides 171 and 172, and opposed back surface 173 and front surface 174. Front surface 174 of each key 170 is shaped and has a radius of curvature configured to facilitate omnidirectional pivotal movement of said shaft 110 relative to the adjoining end housing 150 and, more specifically, concave seat surface 160 thereof.

Figure 7A:
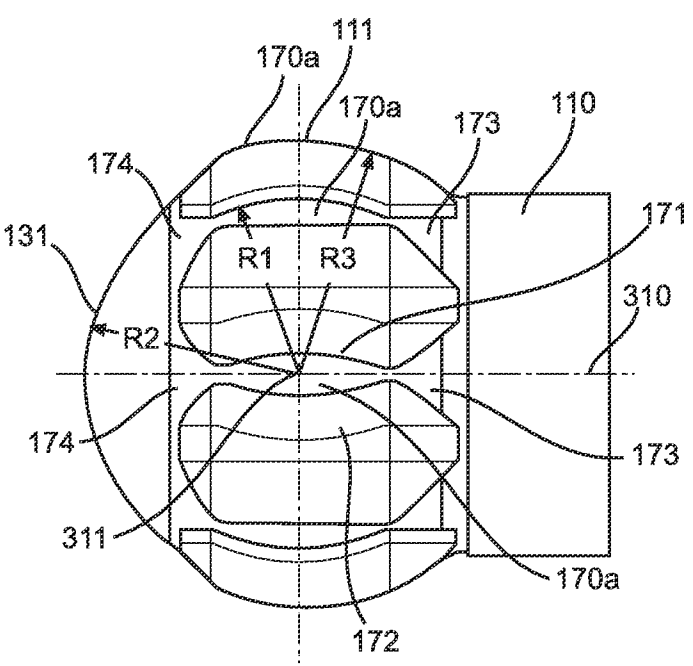
FIG. 7A depicts an end view of an end of a drive shaft of the present invention.
Figure 7:
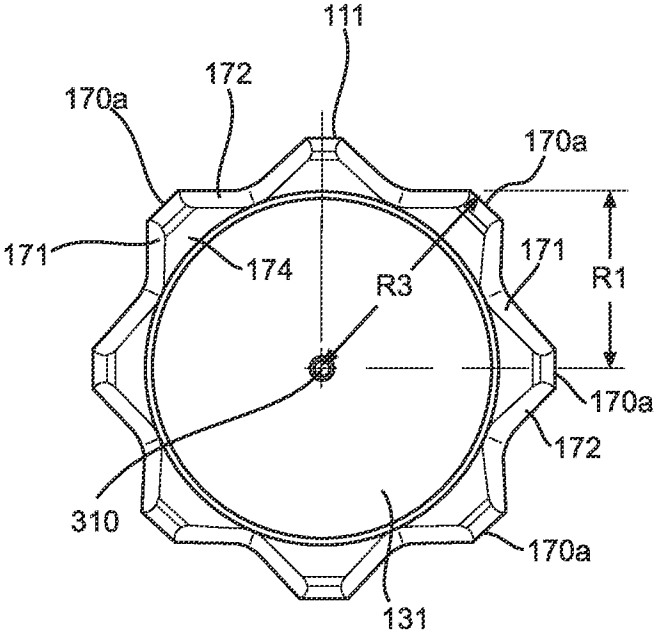
FIG. 7 depicts an end view of an end of a drive shaft of the present invention.

FIG. 7 depicts an end view of end 111 of central drive shaft 110, while FIG. 7A depicts a side view of end 111 of a central drive shaft 110 of the present invention. It is to be observed that the side view depicted in FIG. 7A is rotated approximately 90 degrees about a substantially vertical axis compared to the end view depicted in FIG. 7.

Figure 8A:
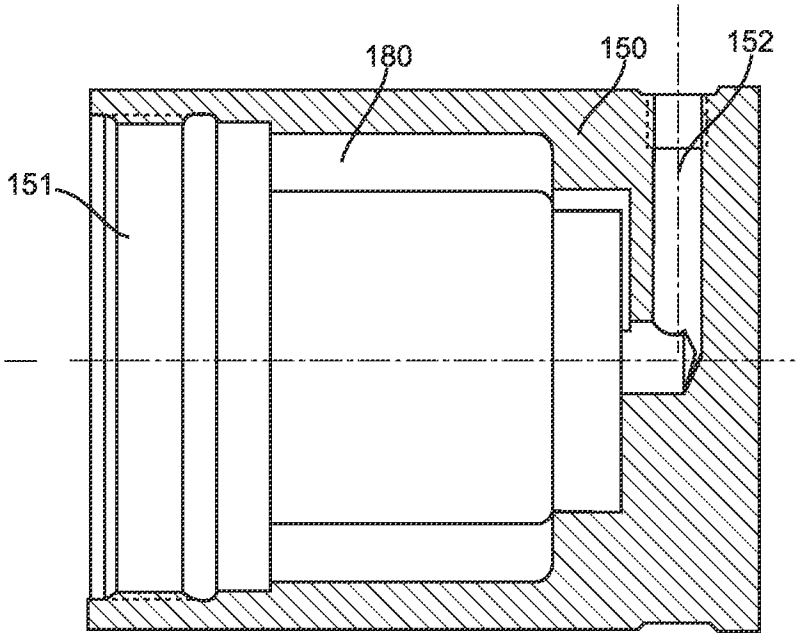
FIG. 8A depicts a side sectional view of an end housing of the present invention.
Figure 8:
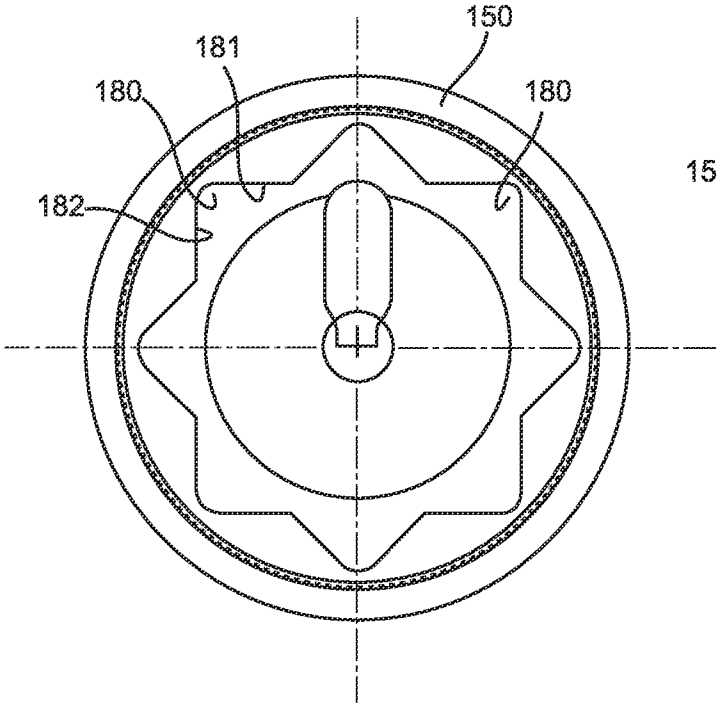
FIG. 8 depicts an end view of an end housing of the present invention.
Figure 9A:
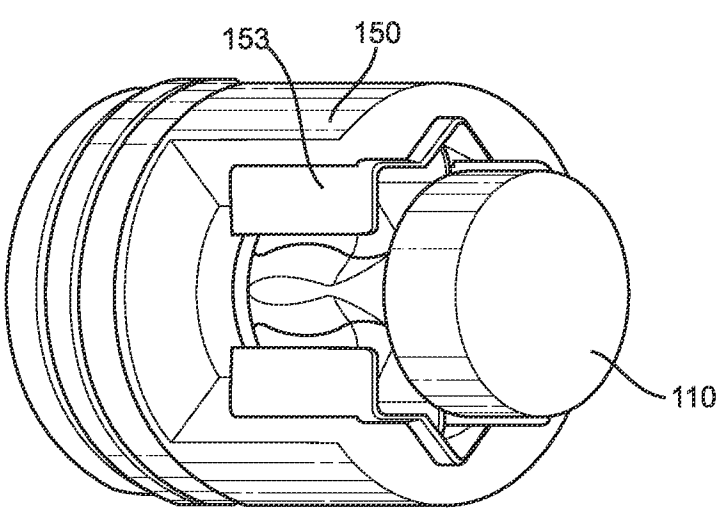
FIG. 9A depicts a perspective and partial cut-away view of a portion of a drive shaft assembly of the present invention (with inserts installed).
Figure 9:
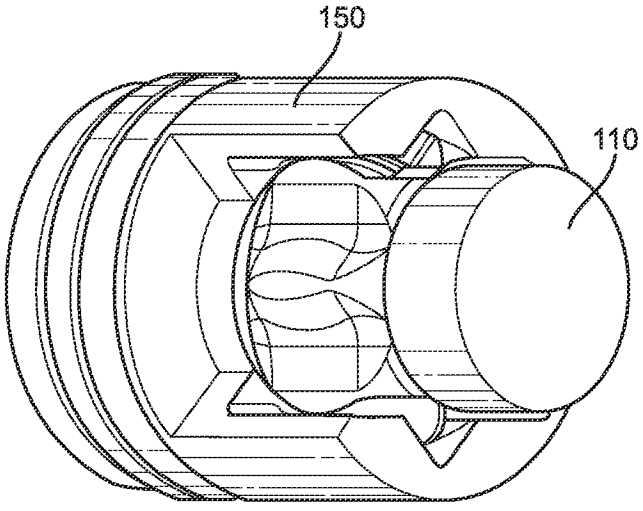
FIG. 9 depicts a perspective and partial cut-away view of a portion of a drive shaft assembly of the present invention (without inserts installed).

FIG. 8 depicts an end view of an end housing 150, while FIG. 8A depicts a side sectional view of said end housing 150 of the present invention. FIGS. 9 and 9A depict perspective and partial cut-away views of a portion of a drive shaft assembly 100 of the present invention without inserts 153 installed (FIG. 9, as also depicted in FIG. 5A) and with inserts 153 installed (FIG. 9A, as also depicted in FIG. 5).

In the embodiment of drive shaft assembly 100 depicted in FIGS. 1 and 2, each end of central drive shaft 110 can be oriented at a different axis angle compared to the opposite end of said central drive shaft 110. Torque and rotational forces can be transferred through said drive shaft assembly 100 even when each end is aligned with a different axis—that is, oriented at a different angle relative to the other opposing end. Referring to FIGS. 3 and 4, it is to be observed all articulation of drive shaft 110 is substantially centered on the same center point 311 of ends 111 and 112.

Similarly, referring to FIGS. 1A and 2A, articulation of end 211 of first alternative embodiment drive shaft assembly 200 is likewise substantially centered on said center point 311. Central drive shaft 210 can be oriented at a different axis angle compared to the opposite end of said central drive shaft 210. Torque and rotational forces can be transferred through said drive shaft assembly 200 even when each end is aligned with a different axis—that is, oriented at a different angle relative to the other opposing end.

Referring to FIGS. 3 and 4, each of the opposing ends 111 and 112 of said central drive shaft 110 have a rounded or partially-spherical surface (131 and 132, respectively). Each of said opposing ends has a single center point 311 as the pivotal or rotational point of rotation or articulation of said central drive shaft 110. (It is to be observed that the terms center point of rotation and center point of articulation are used interchangeably herein) Referring to FIG. 2, end surface 131 of end 111 of central drive shaft 110 engages against a concave partial-spherical surface 160 of similar dimensions and radius of curvature located within end housing 150. Similarly, end surface 132 of end 112 of central drive shaft 110 engages against a concave partial-spherical surface 160 of similar dimensions located within end housing 155.

In this manner, said central drive shaft 110 facilitates the transfer of thrust load forces across drive shaft assembly 100 of the present invention generated substantially along the longitudinal axis 210 of central drive shaft 110. Partial-spherical seat surfaces 160 can be either integrally formed within end housings 150 and 155 or, alternatively, added as a separate component to central drive shaft 110 and/or end said housings 150 and/or 155.

Referring back to FIG. 6, a plurality of keys 170 extend radially outward from substantially cylindrical end 111 of central drive shaft 110 in spaced relationship. In a preferred embodiment, each of said keys 170 has an outer lateral surface 170*a*, as well as a primary load contact surface 171 and counter load contact surface 172. Each of said keys 170 further comprises a back surface 173 and a front surface 174. Although not depicted in FIG. 6, it is to be observed that end 112 of central drive shaft 110, as well as end 211 of drive shaft 210 of alternative embodiment drive shaft assembly 200, have a substantially similar configuration. Accordingly, the following description of end 111 of central drive shaft 110 and end member 150 is applicable to end 112 of said drive shaft 110 and end member 155, as well as drive shaft 210 and end member 250 of alternative embodiment drive shaft assembly 200.

Referring to FIGS. 7 and 7A, primary load contact surfaces 171 are offset both parallel and perpendicular to axis 310 of drive shaft 110, while counter load contact surfaces 172 are also offset both parallel and perpendicular to said axis 310 of drive shaft 110. Primary load contact surface 171 and counter load contact surface 172 of said central drive shaft 110 each have a rounded or convex curvature with a center line running substantially through the single center point of articulation 311 (as seen in FIG. 7A). In a preferred embodiment, said shaft primary load contact surface 171 and counter load contact surface 172 of each key 170 are oriented perpendicular to, and comprise mirror images of, each other. As depicted in FIGS. 8 and 8A, end housing 150 has primary load contact surface 181 and counter load contact surface 182 that are also oriented substantially perpendicular to each other; in a preferred embodiment, said primary load contact surface 181 and counter load contact surface 182 comprise substantially flat surfaces. As depicted in FIG. 7, it is to be observed that any number of sets of primary and counter load contact surfaces may be formed and spaced around the central longitudinal axis 310 of drive shaft 110.

During articulation of central drive shaft 110 along a plane oriented parallel to the flat load contact surface 181 of end housing 150, the tangentially contacting curved convex load contacting surface 171 of said central drive shaft 110 slides on the flat surface of 181. During articulation of central drive shaft 110 along a plane oriented perpendicular to the flat load contact surface 181 of end housing 150, the tangentially contacting curved convex load contacting surface 171 of said central drive shaft 110 rotates/rocks on the flat surface of 181. During articulation of central drive shaft 110 along a plane oriented parallel to the flat load contact surface 182 of end housing 150, the tangentially contacting curved convex load contacting surface 172 of said central drive shaft 110 slides on the flat surface of 182. During articulation of central drive shaft 110 along a plane oriented perpendicular to the flat load contact surface 182 of end housing 150, the tangentially contacting curved convex load contacting surface 172 of said central drive shaft 110 rotates/rocks on the flat surface of 181. In a preferred embodiment, such articulation can comprise a combination of sliding and rotating motions, thereby permitting omnidirectional articulation of drive shaft 110 in virtually any radial direction relative to a mating end housing (but always around single articulation/rotation center point 311).

Still referring to FIGS. 7 and 7A, it is to be observed that the various radii depicted as "R1", "R2" and "R3" all originate from the same common articulation center point 311. Dimension "R1" represents the distance from said articulation center point 311 to the outer surface of primary load contact surface 171 (as well as the outer surface of counter load contact surface 172); as such, dimension "R1" represents the cylindrical radius of curvature of primary load contact surface 171 and counter load contact surface 172 of keys 170, as best seen on FIG. 7A. The radius "R1" of the convex load contacting surface 171 and 172 of central drive shaft 110 is maximized within the design constraints of load contact of surface 181 and 182 of end housing 150. The maximized radius will carry higher surface contact loads compared against other conventional driveline designs with smaller radius contacting surfaces. Dimension "R2" represents the distance from said articulation center point 311 to end surface 131. As depicted in FIGS. 7 and 7A, dimension "R3" represents a distance from said center point 311 to an outer lateral surface 170*a* of keys 170; in a preferred embodiment, it is to be observed that keys 170 can have a sloping radius of curvature, such that dimension R3 is greater near surface 174 than near surface 173.

Referring to FIGS. 9 and 9A, optional wear plate or load transmission insert(s) 153 can be installed between said central drive shaft 110 load contact surfaces and mating surfaces of end housing 150. Said wear plate or insert(s) 153 can be beneficially formed from a single-piece fitting disposed between both the primary and counter load contact surfaces; alternatively, said wear plate or insert(s) 153 can comprise a plurality of separate pieces. For example, said wear plate or insert(s) 153 can comprise one wear surface for primary load contact surface(s) and a second wear surface for counter load contact surface(s); each with one face matching the central drive shaft load contact surface, and an opposite face matching an end housing load contact surface.

In operation, the drive shaft assembly of the present invention can be used to operationally couple components of a downhole drilling assembly (such as, for example, a power section and bearing assembly of a downhole mud motor). The drive shaft assembly allows for articulation in virtually any radial direction relative to its central longitudinal axis, as well as the longitudinal axes of the coupled components. The drive shaft assembly of the present invention also permits transfer of rotational and thrust forces across said drive shaft assembly.

Figure 10:
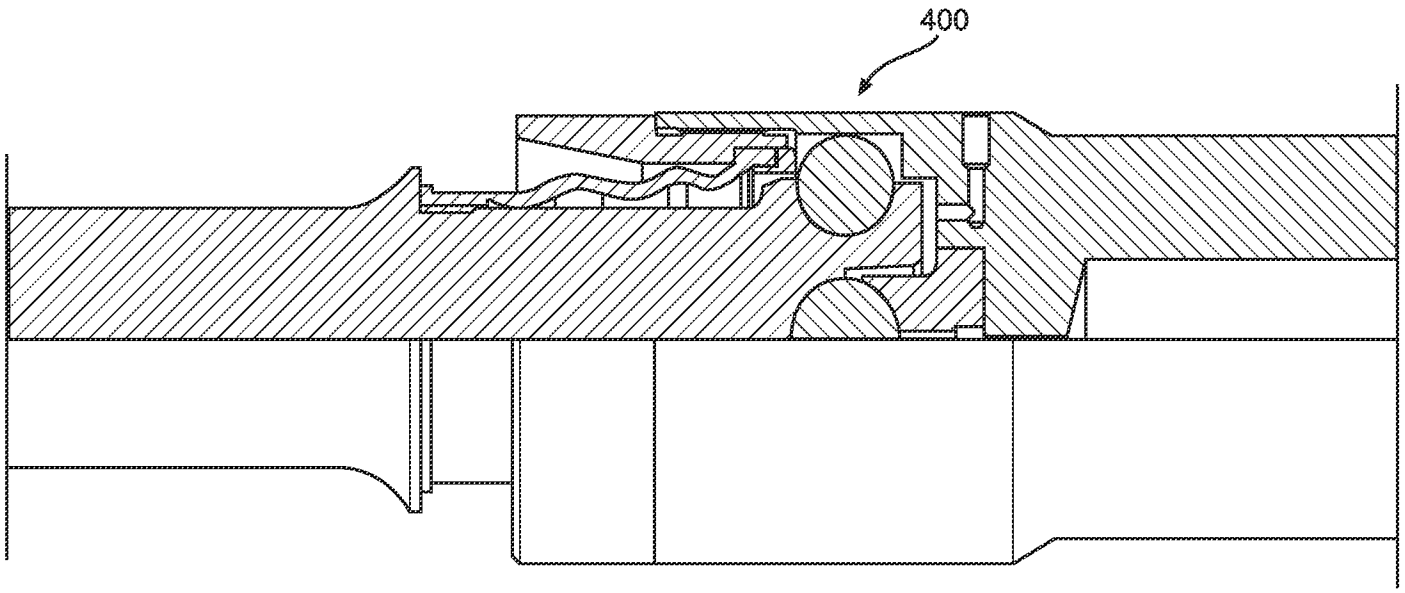
FIG. 10 PRIOR ART
FIG. 10 depicts a side, partial cut-away view of a conventional ball/seat drive line (prior art).

The drive shaft assembly of the present invention exhibits a number of benefits compared to conventional drive line designs including, without limitation, the following:

Compared against conventional ball drives (depicted in FIG. 10), cylindrical contact surfaces have a much larger diameter equating to larger surface contact during operation resulting in reduced wear. Said cylindrical contact faces, when compared to ball contact, generate a larger contact area in general (i.e. line contact vs. point contact). Moreover, use of wear plates or load transmission inserts 153 further reduce the wear on the more expensive driveshaft and end housing components. Said elongate keys 170 (including, without limitation, the dimensions and geometry thereof) greatly increases the surface contact area between said central drive shaft 110 and end housings 150 and 155, thereby increasing the torque load capacity of the drive shaft assembly 100 of the present invention.

Compared against conventional spline drives or involute spline-type drives, cross sectional area between primary and counter load contact surfaces is substantially larger, reducing risk of shearing during operation and allowing for much greater wear on opposing surfaces. Additionally, the drive shaft assembly of the present invention is much more robust in situations with mud invasion through elastomeric boot seals having the ability to withstand large amounts of wear. Machining of driveshaft joint and end housing contact surfaces is much simpler and more cost effective, while root radii and transition radii between milled surfaces much larger resulting in less stress concentrations under load. If desired, root radii may be sharp as a means of increasing contact area With the drive shaft assembly of the present invention, all rotation and contact surface motion is centered on and moves around the same center point of rotation 311. Counter rotation movement is minimal and only needs to account for machining fit and tolerance with little or no consideration of wedging with increased levels of angular articulation.

Compared against polygonal transmission joint designs, the torsional contact surface is located further away from driveshaft axis resulting in reduced surface load at equivalent torque. The present invention provides the opportunity to have more contact surfaces around the circumference of central drive shaft without a reduction in distance to the drive shaft axis. Further, with the present invention, all rotation and contact surface motion centered on the same center point of rotation. By contrast, polygonal transmission joint designs have an axis of rotation on the torsional contact surfaces offset from the driveline center point of rotation which equates to uneven motion and possible wedging of geometry.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A drive shaft assembly for coupling downhole components comprising:

a) an end housing having a central bore defining an inner space, and a concave seat surface and a plurality of circumferentially spaced keyways disposed within said inner space; and b) a drive shaft having a first end and a second end, wherein said first end has a partially spherical end surface and a plurality of elongated keys extending radially outward from said shaft and is received within said inner space of said end housing, and wherein said partially spherical end surface is movably received on said seat surface, and wherein each of said keys comprises a lateral outer surface, a first side load contact surface having a convex shape, and an opposing second load contact surface having a convex shape, and wherein said keys are received within said keyways and are configured to transfer torque forces between said drive shaft and said end housing.

2. The drive shaft assembly of claim 1, wherein said drive shaft is configured for omnidirectional pivotal movement relative said end housing about a single point of rotation.

3. The drive shaft assembly of claim 1, wherein said partially spherical end surface engages against said seat during pivotal movement of said drive shaft relative to said end housing.

4. The drive shaft assembly of claim 1, wherein each key of said plurality of keys slides within a corresponding keyway of said plurality of said keyways during pivotal movement of said drive shaft relative to said end housing.

5. The drive shaft assembly of claim 1, wherein each key of said plurality of keys has a front surface, and wherein each of said front surfaces of said keys is rounded, and is configured to engage against said seat during pivotal movement of said drive shaft relative to said end housing.

6. A drive shaft assembly for coupling downhole components comprising:

a) an end housing having a central bore defining an inner space, and a concave seat surface and a plurality of circumferentially spaced keyways disposed within said first inner space; and b) a drive shaft, further comprising a first end having a partially spherical end surface and a plurality of elongated keys extending radially outward from said shaft, wherein said first end is received within said inner space of said end housing, and wherein said partially spherical end surface is movably received on said seat surface, and each of said plurality of keys comprises a lateral outer surface, a first side load contact surface having a convex shape, and an opposing second load contact surface having a convex shape and oriented perpendicular to said first side load contact surface, and wherein said plurality of keys is received within said plurality of keyways and are configured to transfer torque forces between said drive shaft and said end housing.

7. The drive shaft assembly of claim 6, wherein said first end of said drive shaft is configured for omnidirectional pivotal movement relative to said end housing about a point of rotation.

8. The drive shaft assembly of claim 6, wherein said partially spherical end surfaces engages against said seats during pivotal movement of said drive shaft relative to said end housings.

9. The drive shaft assembly of claim 6, wherein each key of said plurality of keys slides within a corresponding keyway of said plurality of said keyways during pivotal movement of said drive shaft relative to said end housings.

10. The drive shaft assembly of claim 6, wherein each of said plurality of keys further comprises a front surface and a rear surface.

11. The drive shaft assembly of claim 10, wherein each of said front surfaces of said plurality of keys is rounded, and is configured to movably engage against said seat during pivotal movement of said drive shaft relative to said end housing.

12. The drive shaft assembly of claim 10, wherein each of said keyways of said plurality of keyways have opposing flat surfaces configured to engage with said opposed convex side load contact surfaces of said plurality of keys.

13. A drive shaft assembly for coupling downhole components comprising:

a) a first end housing having a central bore defining a first inner space, and a first concave seat surface and a first plurality of circumferentially spaced keyways disposed within said first inner space, wherein each of said first plurality of keyways further comprises a pair of opposed flat surfaces;

b) a second end housing having a central bore defining a second inner space, and a second concave seat surface and a second plurality of circumferentially spaced keyways disposed within said second inner space, wherein each of said second plurality of keyways further comprises a pair of opposed flat surfaces;

c) a drive shaft, further comprising:

i) a first end having a first partially spherical end surface and a first plurality of elongated keys extending radially outward from said shaft, each of said first plurality of keys having opposing curved and convex side load contact surfaces, wherein said first partially spherical end surface is movably received on said first seat surface and said first plurality of keys are received within said first plurality of keyways, and wherein said opposing curved and convex side load contact surfaces of said first plurality of keys engage against said flat surfaces of said first plurality of keyways and are configured to transfer torque forces between said drive shaft and said first end housing; and ii) a second end having a second partially spherical end surface and a second plurality of elongated keys extending radially outward from said shaft, each of said second plurality of keys having opposing curved and convex side load contact surfaces, wherein said second partially spherical end surface is movably received on said second seat surface and said second plurality of keys are received within said second plurality of keyways, and wherein said opposing curved and convex side load contact surfaces of said second plurality of keys engage against said flat surfaces of said second plurality of keyways and are configured to transfer torque forces between said drive shaft and said second end housing.

14. The drive shaft assembly of claim 13, wherein said first end of said drive shaft is configured for omnidirectional pivotal movement relative to said first end housing about a first point of rotation.

15. The drive shaft assembly of claim 13, wherein said second end is configured for omnidirectional pivotal movement relative to said second end housing about a second point of rotation.

* * * * *